US009126454B2

(12) United States Patent
Takahashi

(10) Patent No.: US 9,126,454 B2
(45) Date of Patent: Sep. 8, 2015

(54) SLIM TYPE BALLPOINT PEN

(71) Applicant: Matsumine Takahashi, Kawagoe (JP)

(72) Inventor: Matsumine Takahashi, Kawagoe (JP)

( * ) Notice: Subject to any disclaimer, the term of this patent is extended or adjusted under 35 U.S.C. 154(b) by 125 days.

(21) Appl. No.: 14/017,537

(22) Filed: Sep. 4, 2013

(65) Prior Publication Data

US 2014/0334864 A1 Nov. 13, 2014

(30) Foreign Application Priority Data

May 21, 2013 (JP) ..... 2013-106691

(51) Int. Cl.

| | |
|---|---|
| ***B43K 7/12*** | (2006.01) |
| ***B43K 7/02*** | (2006.01) |
| ***B43K 24/04*** | (2006.01) |
| ***B43K 24/08*** | (2006.01) |
| ***B43K 7/00*** | (2006.01) |

(52) U.S. Cl.

CPC . *B43K 7/12* (2013.01); *B43K 7/005* (2013.01); *B43K 7/02* (2013.01); *B43K 24/04* (2013.01); *B43K 24/08* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,657,812 | A * | 4/1972 | Lee | 30/162 |
| 6,309,122 | B1 * | 10/2001 | Wang | 401/112 |
| 6,752,557 | B1 * | 6/2004 | Hsieh | 401/117 |
| 6,773,185 | B1 * | 8/2004 | Hsieh | 401/105 |
| 2002/0110403 | A1 | 8/2002 | Nishitani | |

FOREIGN PATENT DOCUMENTS

| | | | |
|---|---|---|---|
| JP | 11-342696 | A | 12/1999 |
| JP | 2002-307892 | A | 10/2002 |
| JP | 2004-237662 | A | 8/2004 |
| JP | 2011-42035 | A | 3/2011 |

* cited by examiner

*Primary Examiner* — David Walczak
(74) *Attorney, Agent, or Firm* — Richard M. Goldberg

(57) ABSTRACT

A slim type ballpoint pen includes, a refill, a knock part, a spring and a spring stopper disposed in a shaft tube, a front hole or front slit and a rear slit 12 continuously provided in the shaft tube, and an insertion hole into which a button is inserted in the knock part, so that writing state is maintained by moving a rear end of the knock part or a projection on the knock part forward and projecting a middle body of the button upward at a rear end of the front hole or front slit, the button including an upper body part having the smallest diameter, a middle body part having a middle diameter and a lower body part having the largest diameter, and a not-writing state is maintained by projecting the upper body part upward at a rear end of the rear slit.

10 Claims, 2 Drawing Sheets

Fig. 3 (a)
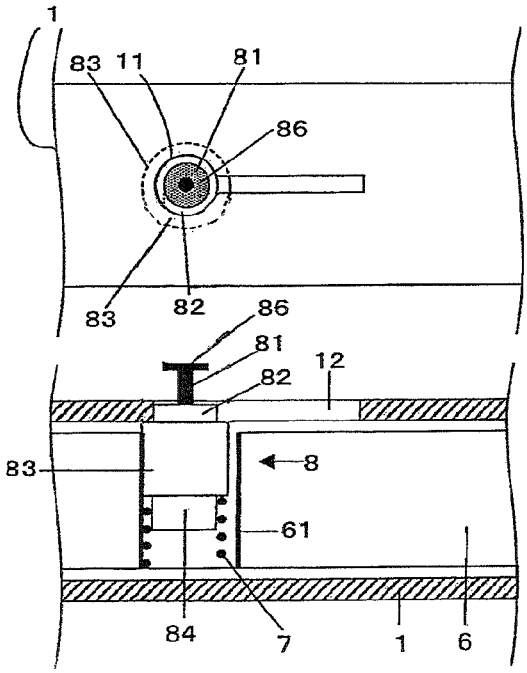
Fig. 3 (b)
Fig. 3 (c)
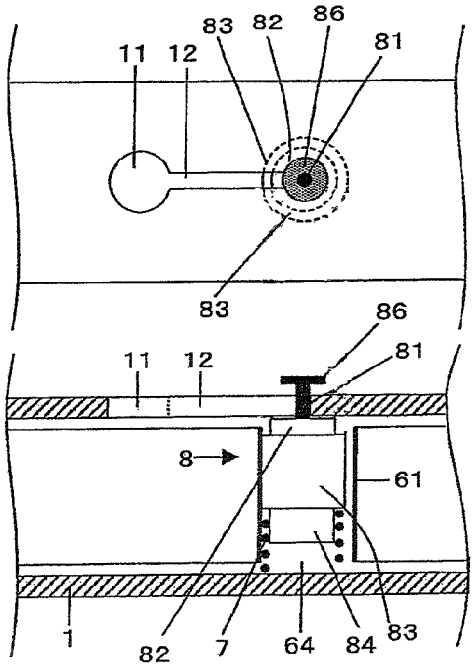
Fig. 3 (d)
Fig. 4 (a)
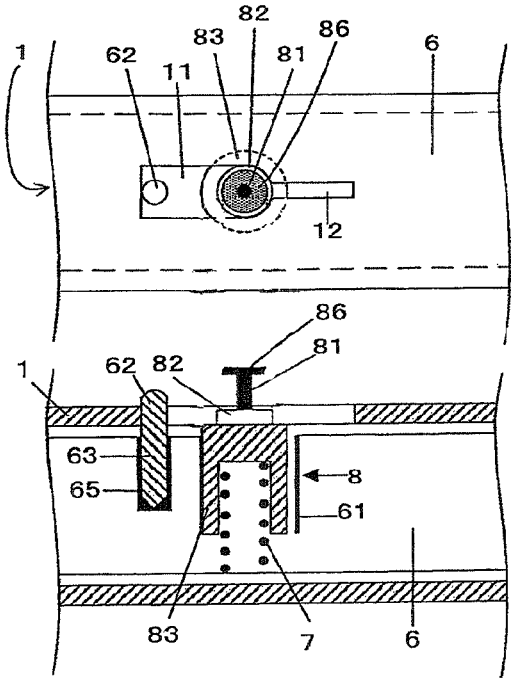
Fig. 4 (b)
Fig. 4 (c)
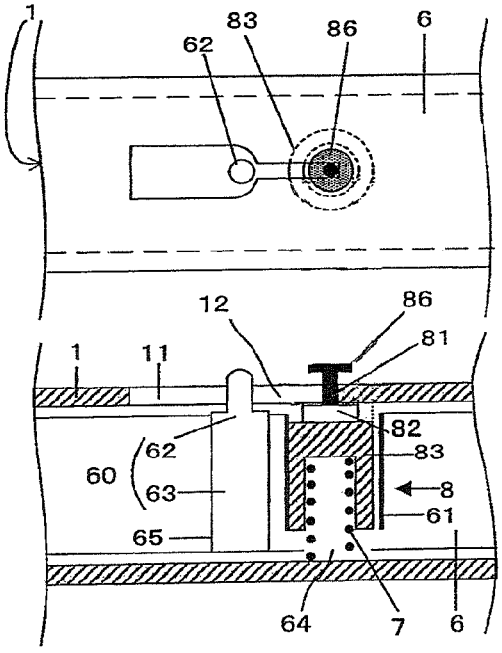
Fig. 4 (d)

SLIM TYPE BALLPOINT PEN

TECHNICAL FIELD

The present invention relates to a ballpoint pen realizing a writing state by advancing of a knock part and a refill, and, more particularly, to a slim type ballpoint pen designed with a small-diameter shaft tube.

BACKGROUND OF THE INVENTION

To date, the applicant has proposed constitutions of various types of ballpoint pens and filed patent applications thereon.

For example, a ballpoint pen disclosed in Patent Document 1 has an outer tube part capable of being screwed onto a writing tool body. During use, the writing tool body is covered from the outside, and thus the ballpoint pen can have a thickness suitable for being gripped. On the other hand, when not in use, a lead tip or a pen tip is covered from the outside, and thus not only can falling or vibration of the pen be prevented from causing damage to the tip, but the tip can be prevented from causing a puncture wound when the pen is pocketed.

Since a ballpoint pen disclosed in Patent Document 2 has a damper element having a specific structure in a shaft tube, elastic force of a refill spring can be reduced if necessary when a refill and a rotor retreat, and thus comfortable operation of a knock part can be realized.

Thereupon, recently, a slim type ballpoint pen has been required which has a small-diameter shaft tube so as to be realized compactly supported state in a pocket and speedy writing by simple gripping.

However, a specific device in designing for making a slim type ballpoint pen has not been created in the inventions disclosed not only in Patent Documents 1 and 2 but also in other publications.

PRIOR ART

Patent Document

[Patent Document 1] Japanese Published Unexamined Patent Application No. H11-342696

[Patent Document 2] Japanese Published Unexamined Patent Application No. 2002-307892

SUMMARY OF THE INVENTION

Problem to be Solved by the Invention

It is an object of the present invention to provide a slim type ballpoint pen which includes a shaft tube and a knock part, each having a small length in a before-behind direction and a small diameter, so as to be realized compactly supported state in a pocket and speedy writing.

Means for Solving the Problem

In order to achieve the above object, the present invention provides slim type ballpoint pens having the following basic constitutions:

(1) A slim type ballpoint pen comprising:

a shaft tube having a cap secured to a forward end thereof, a refill having a pipe storing ink therein and a pen tip housed in the tube for movement in forward and reverse directions, an arrangement for moving the pen tip in the forward and reverse directions, the arrangement including a knock part and a backward elastic force of a spring, respectively, the pipe storing ink along a longitudinal direction of the shaft tube and the knock part being movable in the forward and reverse directions and being fitted at a rear end of the shaft tube, and the spring is elastically fixed between a rear end of the cap and a spring stopper fixed to a rear end of the refill;

a front hole and a rear slit are continuously provided, in the shaft tube, behind the spring stopper, an insertion hole is projected downward in the knock part, a button to be inserted into the insertion hole including an upper body part, a middle body part and a lower body part, the upper body part having a diameter adapted to pass upward through the front hole, the rear slit and the insertion hole, the middle body part having a diameter adapted to pass upward through the front hole and the insertion hole and not passing upward through the rear slit, the lower body part having a diameter adapted to pass upward through the insertion hole and not passing upward through either the front hole or the rear slit, the lower body part is supported from a lower side and adapted to be powered upward by a vertical spring, and a lower end of the vertical spring is supported on one of:

a lower inner wall of the knock part and a lower inner wall of the shaft tube in a state of passing through a lower hole of the knock part;

wherein in a writing state, the middle body part projects upward to contact a rear end of the front hole, and the lower body part projects upward from the insertion hole to contact a front end of an inner wall of the insertion hole;

wherein in a not-writing state, the upper body part projects upward to contact a rear end of the rear slit, and the front end of the inner wall of the insertion hole contacts with the lower body part; and wherein the length of the knock part in a forward and reverse direction is set so that a rear end of the knock part projects backward more than the rear end of the shaft tube.

(2) A slim type ballpoint pen comprising:

a shaft tube having a cap secured to a forward end thereof, a refill having a pipe storing ink therein and a pen tip housed in the tube for movement in forward and reverse directions, an arrangement for moving the pen tip in the forward and reverse directions, the arrangement including a knock part and a backward elastic force of a spring, respectively, the pipe storing ink along a longitudinal direction of the shaft tube and the knock part being movable in the forward and reverse directions and being fitted at a rear end of the shaft tube, and the spring is elastically fixed between a rear end of the cap and a spring stopper fixed to a rear end of the refill;

a front hole and a rear slit are continuously provided, in the shaft tube, behind the spring stopper, an insertion hole is projected downward in the knock part, a fitting-in hole is provided in knock part, a columnar part molded integrally with a lower part of a projection movable in a state of passing upward through the front slit is fitted into the fitting-in hole in front of the insertion hole, the projection is fixed to the fitting-in hole by one of press-bonding and adhering the columnar part to an inner wall of the fitting-in hole with an adhesive agent, a button to be inserted into the insertion hole including an upper body part, a middle body part and a lower body part, the upper body part having a diameter adapted to pass upward through the front hole, the rear slit and the insertion hole, the middle body part having a diameter adapted to pass upward through the front hole and the insertion hole and not passing through the rear slit, the lower body part having a diameter adapted to pass upward through the insertion hole and not passing upward through either the front hole or the rear slit, the lower body part is supported from a lower side and adapted to be powered upward by a vertical spring, and a lower end of the vertical spring is supported on one of:

a lower inner wall of the knock part and a lower inner wall of the shaft tube in a state of passing through a lower hole of the knock part;

wherein in a writing state, the middle body part projects upward to contact a rear end of the front hole, and the lower body part projects upward from the insertion hole to contact a front end of an inner wall of the insertion hole;

wherein in a not-writing state, the upper body part projects upward to contact a rear end of the rear slit, and the front end of the inner wall of the insertion hole contacts with the lower body part; and wherein the length of the knock part in a forward and reverse direction is set so that a rear end of the knock part does not project backward more than the rear end of the shaft tube.

BRIEF DESCRIPTION OF THE DRAWINGS

FIG. 3 is a plan view showing engagement relationships between a button and a shaft tube and between the button and a knock part in a writing state and a not-writing state in the basic constitution (1), FIGS. 3(*a*) and 3(*b*) shows the writing state and FIGS. 3(*c*) and 3(*d*) shows the not-writing state.

FIG. 4 is a plan view showing engagement relationships between a button and a shaft tube and between the button and a knock part in a writing state and a not-writing state in the basic constitution (2), FIGS. 4(*a*) and 4(*b*) shows the writing state and FIGS. 4(*c*) and 4(*d*) shows the not-writing state.

DESCRIPTION OF THE SYMBOLS

Figure 1:
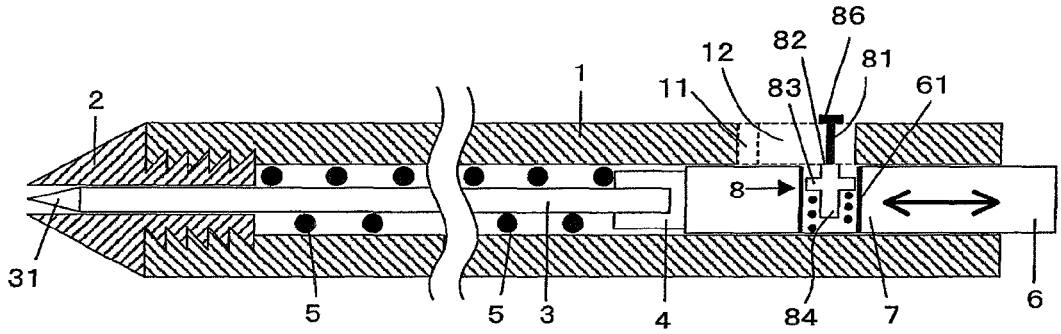
FIG. 1 is a sectional side view showing the basic constitution (1), and shows a neutral state belonging to neither writing state nor not-writing state.

1: shaft tube
11: front hole or front slit
12: rear slit
2: cap
3: refill
31: pen tip
4: spring stopper
5: spring
6: knock part
61: knock part insertion hole
62: projection
63: columnar part
64: lower side hole
65: fitting-in hole
7: vertical spring
8: button
81: upper body part
82: middle body part
83: lower body part
84: lower side projection
85: hollow part
86: touch plate

BEST MODE FOR CARRYING OUT THE INVENTION

Basic principles of operations of the above-described basic constitutions (1) and (2) will be described first.

As shown in FIG. 1, in the basic constitution (1), advancing of a knock part 6 and a refill 3 necessary for writing is realized by pressing a rear end of the knock part 6 with a finger. For making a change to a not-writing state, a spring 5 powers and moves the knock part 6 backward so as to project the rear end of the knock part backward more than a rear end of a shaft tube 1.

Figure 2:
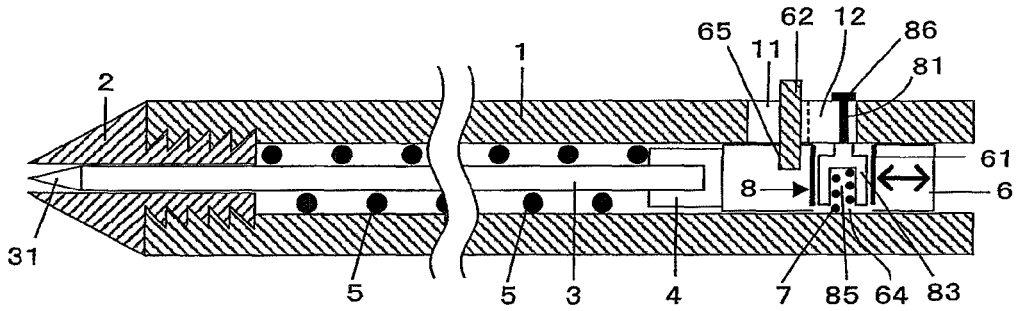
FIG. 2 is a sectional side view showing the basic constitution (2), and shows a neutral state belonging to neither writing state nor not-writing state.

On the other hand, as shown in FIG. 2, in the basic constitution (2), advancing of the knock part 6 and the refill 3 necessary for writing is realized by taking a projection 62, which passes upward through a front slit 11 of the shaft tube 1, with fingers to move the projection forward. For making a change to a not-writing state, the spring 5 powers and moves the knock part 6 backward so as not to project the rear end of the knock part from the rear end of the shaft tube 1.

As shown in FIGS. 3(*a*) and 3(*b*), in the basic constitution (1), for maintaining a writing state, a vertical spring 7 powers a middle body part 82 of a button 8 advancing with the knock part 6 to make the part 82 pass upward through an insertion hole 61 of the knock part and a front hole 11 of the shaft hole 1, the vertical spring 7 further powers a lower body part 83 to make the part 83 pass upward through the insertion hole 61 of the knock part and to bring the part 83 into contact with a lower side of the front hole 11 in the shaft tube 1, and backward movement of the knock part 6 is prevented via contact of a rear end of the front hole 11 in the shaft tube 1 with the middle body part 82 and contact of a front end of the insertion hole 61 of the knock part with the lower body part 83, the contacts being brought backward with powering by the spring 5.

In the case of cancelling the writing state, the upward insertion of the middle body part 82 in the front hole 11 in the shaft tube 1 and the contact of the rear end of the hole 11 with the part 82 are cancelled by pressing the button 8 downward with a finger, the spring 5 powers an upper body part 81 so as to move or slide the part 81 along a rear slit 12, and the knock part 6 is moved backward.

As shown in FIGS. 3(*c*) and 3(*d*), for maintaining the not-writing state, contact of a rear end of the rear slit 12 with a part, which is inserted upward in the slit 12, of the upper body part 81 and the contact of the front end of the insertion hole 61 of the knock part with the the middle body part 82 or lower body part 83 prevent the knock part 6 from moving further backward.

In addition, whether a front end of the insertion hole 61 of the knock part contacts with the middle body part 82 or the lower body part 83 is decided in accordance with a ratio of vertical lengths of the middle body part 82 and the lower body part 83.

As shown in FIGS. 4(*a*) and 4(*b*), in the basic constitution (2), for maintaining the writing state, the vertical spring 7 powers the middle body part 82 of the button 8 advancing with the knock part 6 to make the part 82 pass upward through the insertion hole 61 of the knock part and the front slit 11 of the shaft hole 1, the vertical spring 7 further powers the lower body part 83 to make the part 83 pass upward through the insertion hole 61 of the knock part and to bring the part 83 into contact with the lower side of the front slit 11 in the shaft tube 1, and the backward movement of the knock part 6 is prevented via the contact of the rear end of the front hole 11 in the shaft tube 1 with the middle body part 82 and the contact of the front end of the insertion hole 61 of the knock part with the lower body part 83, the contacts being brought the backward with powering by the spring 5.

In the case of cancelling the writing state, the upward insertion of the middle body part 82 in the front slit 11 of the shaft tube 1 and the contact of the rear end of the hole 11 with the part 82 are cancelled by pressing the button 8 downward with a finger, the spring 5 rearward powers an upper body part 81 so as to move or slide the part 81 along a rear slit 12, and the knock part 6 is moved backward.

As shown in FIGS. 4(*c*) and 4(*d*), for maintaining the not-writing state, contact of a rear end of the rear slit 12 with a part, which is inserted upward in the slit 12, of the upper body part 81 and the contact of the front end of the insertion hole 61 of the knock part with the middle body part 82 or lower body part 83 prevent the knock part 6 from moving further backward.

In addition, whether a lower end of the insertion hole 61 of the knock part contacts with the middle body part 82 or the lower body part 83 is decided in accordance with a ratio of vertical lengths of the middle body part and the lower body part 83 as the case of basic constitution (1).

In the basic constitutions (1) and (2), a pipe of the insertion hole 61 for inserting the button 8 is projected downward in the knock part 6 so that the knock part 6 can move before-behind integrally with the button 8 contacting with an inner wall of the pipe.

FIG. 1 and FIGS. 3(*a*)-3(*d*) show the case where the pipe reaches a lower inner wall of the knock part 6, and FIG. 2 and FIGS. 4(*a*)-4(*d*) show the case where the pipe does not reach the lower inner wall but reaches a middle part of the inner wall of the knock part 6. In both the cases, in the not-writing state, as described above, the button and the knock part can integrally move by the contact of the insertion hole 61 with the lower body part 83 in the not-writing state.

When the knock part 6 moves before-behind, an upper end of the middle body part 82 of the button 8 slides on a lower end surface of the side of the rear slit 12 in the shaft tube 1 while being powered upward by the vertical spring 7, and kinetic frictional resistance force is generated by the sliding. However, since a backward powering force of the spring 5 along with contact of the front wall of the pipe forming the insertion hole 61 with the lower body part 83 and forward moving force with a finger are larger than the kinetic frictional resistance force, the kinetic frictional resistance force by the sliding does not obstruct before-behind movement of the knock part.

On the other hand, powering force by the vertical spring 7 is required to be set so that the backward powering force of the spring 5 and the forward moving force with the finger are larger than the kinetic frictional resistance force.

FIG. 1, FIGS. 3(*a*) and 3(*b*) and FIGS. 4(*a*) and 4(*b*) show the vertical spring 7 contacting with the lower inner wall of the knock part 6, FIG. 2, FIGS. 3(*c*) and 3(*d*) and FIGS. 4(*c*) and 4(*d*) show the vertical spring 7 contacting with a lower inner wall of the shaft tube 1, and both the contact constitutions may be adopted in the basic constitutions (1) and (2).

In the case where the vertical spring 7 contacts with the lower inner wall of the knock part 6, there exists an advantage that a lower end of the vertical spring does not slide on the lower inner wall of the shaft tube 1 even if the knock part 6 moves. However, since the vertical spring 7 is short in vertical movement distance and extremely compressed, elastic fatigue is easily caused.

On the other hand, in the case where the vertical spring 7 contacts with the lower inner wall of the shaft tube 1, it slides on the lower inner wall and is slightly worn. However, there exists an advantage that the vertical spring 7 can be set long in vertical movement distance and elastic fatigue is hardly caused.

The button 8 shown in FIG. 1 and FIG. 2 includes, at its top part, a touch plate 86 having a diameter larger than that of the upper body part 81 and touchable with a finger. When the writing state is cancelled, the touch plate 86 allows the finger to avoid coming into direct contact with the top part of the upper body part having a small diameter, and the button 8 may be pressed downward by soft touch of the finger with touch plate 86.

In the above basic constitution (2), if the projection 62 concerning forward movement of the knock part 6 and the refill 3 were molded so as to project upward from the knock part 6, the knock part 6 could not then be inserted in the shaft tube 1.

For considering such a situation, in the basic constitution (2), a pipe of a fitting-in hole 65 is projected downward into which a columnar part 63 molded integrally with a lower side of the projection 62 in front of the insertion hole 61 is fitted.

Similar to the pipe forming the insertion hole 61, also the pipe forming the fitting-in hole 65 may be projected downward so as to reach the lower inner wall of the knock part 6 as shown in FIGS. 3(*a*)-3(*d*), or so as not to reach the lower inner wall but to reach the middle part as shown in FIG. 2 and FIGS. 4(*a*)-4(*d*).

In the case where the pipe is projected so as to reach the middle part, if the pipe includes a bottom surface as shown in FIGS. 4(*a*) and 4(*b*), the columnar part 63 may be designed short.

The pipe forming the fitting-in hole 65 is projected downward in the knock part 6 on the lower side of the front slit 11 so that the projection 62 projects upward through the front slit 11 in the shaft tube 1. By press-bonding or adhering the columnar part 63 to an inner wall of the pipe, the projection 62 can be fixed to the fitting-in hole 65.

Note that FIG. 2 and FIGS. 4(*c*) and 4(*d*) show the columnar part is press-bonded to the fitting-in hole 65, and the black line drawn between the columnar part 63 and the fitting-in hole 65 in FIGS. 4(*a*) and 4(*b*) indicates an adhesive state with an adhesive agent.

In both the basic constitutions (1) and (2), of the button 8, at least the lower body part 83, and the whole of the vertical spring 7 (in the case where the lower end of the spring is supported on the lower inner wall of the knock part 6) or a part, which does not pass downward through a lower side hole 64 of the knock part 6, of the vertical spring 7 (in the case where the lower end thereof is supported on the lower inner wall of the shaft tube 1) are required to be disposed in the shaft tube 1 and the knock part 6.

As such a disposing method, the following methods can be adopted:

(a) a method including the steps of: forming a hole (not shown) having a diameter larger than that of the lower body part 83 of the button 8 behind the rear slit 12 in the shaft tube 1 or in front of the front hole or front slit 11 in advance; inserting the vertical spring 7 and the button 8 from the hole and the insertion hole 61 of the knock part (selectable from the cases of inserting the vertical spring 7 and then inserting the button 8, and of inserting both the spring 7 and the button 8 together); moving the button 8 and the knock part 6 forward;

projecting the upper body part 81 of the button 8 upward from the rear slit 12 in the shaft tube 1; and covering the hole formed in the shaft tube 1 with a cover plate (not shown) from outside; and (b) a method including the steps of: inserting the vertical spring 7 and the button 8 in the knock part 6 through the insertion hole 61 of the knock part (selectable from the cases of inserting the vertical spring 7 and then inserting the button 8, and of inserting both the spring 7 and the button 8 together); inserting the button 8 and the knock part 6 into the shaft tube 1 from its rear end opening part; moving the button 8 and the knock part 6 forward while sliding the upper body part 81 of the button 8 on an upper inner wall of the shaft tube 1; projecting the upper body part 81 from the rear slit 12; and covering part of the rear end of the shaft tube 1 with a rear end plate (not shown) (in the basic constitution (1)) or covering the whole of the opening part with a rear end plate (not shown) (in the basic constitution (2)).

EMBODIMENT

Hereinafter, embodiments of the present invention will be described.

Embodiment 1

As shown in FIG. 1 and FIGS. 3(*a*)-3(*d*), Embodiment 1 is characterized in that a spring winding body part having a diameter smaller than that of the lower body part 83 is projected downward on a lower end of the lower body part 83, the vertical spring 7 is wound around the spring winding body part and an upper end of the vertical spring 7 powers a lower end surface of the lower body part 83 upward.

Since the vertical spring 7 is thus wound around a lower side projection 84, engagement of the spring 7 and the button 8 is maintained, and the button 8 may be positionally fixed in the before-behind direction by a vertically elastically powering force. This point is applicable to both the basic constitutions (1) and (2).

Embodiment 2

As shown in FIG. 2, and FIGS. 4(*a*)-4(*d*), Embodiment 2 is characterized in that a spring insertion hollow part 85 is provided through a part of the lower body part 83 and an upper end surface of the hollow part 85 is powered upward by the upper end of the vertical spring 7.

Engagement of the vertical spring 7 and the button 8 is maintained by fitting the vertical spring 7 in the hollow part 85 of the lower body part 83, and the button 8 can be positionally fixed in the before-behind direction by a vertically elastically powering force. This point is applicable to both the basic constitutions (1) and (2).

Effect of the Invention

In the present inventions based on the basic constitutions (1) and (2), a lower body part of a button passes upward through an insertion hole of a knock part and a lower body part contacts with a front end of the insertion hole, a middle body part of the button is inserted in a front hole (basic constitution (1)) or a front slit (basic constitution (2)) and contacts with the front hole or a rear end of the front slit, and thus a pen tip projects from a cap and a writing state is maintained; and a not-writing state is maintained by making an upper body part of the button pass upward through a rear slit and contact with a rear end of the rear slit; and an original function of a ballpoint pen may be shown.

In addition, by setting the distance, influencing advancing for writing and retreat for not-writing, between the contact position of the fitted-in middle body part and the contact position of the fitted-in upper body part to about 3 to 6 mm, the lengths of the shaft tube and the knock part in their longitudinal directions may be made shorter than the lengths of those used in a conventional cam type ballpoint pen. Moreover, since almost all vertical parts are disposed in the knock part and the diameter of the lower body part having the largest diameter may be set to not longer than 1.5 mm, the ballpoint pen has a smaller diameter and may be shaped more slimly than the conventional cam type ballpoint pen.

In particular, since a rear end of the knock part does not project backward from a rear end of the shaft tube even in a not-writing state in the basic constitution (2), the length of the ballpoint pen in its longitudinal direction may be designed to be shorter than that of the ballpoint pen normally designed and the basic constitution (1) in which the rear end of the knock part projects backward in relation thereto in the not-writing state.

INDUSTRIAL APPLICABILITY

As described above, the present invention may be widely used as a compact type ballpoint pen.

What is claimed is:

1. A slim type ballpoint pen comprising:

a shaft tube having a cap secured to a forward end thereof, a refill having a pipe storing ink therein and a pen tip housed in the tube for movement in forward and reverse directions, an arrangement for moving the pen tip in the forward and reverse directions, the arrangement including a knock part and a backward elastic force of a spring, respectively, the pipe storing ink along a longitudinal direction of the shaft tube and the knock part being movable in the forward and reverse directions and being fitted at a rear end of the shaft tube, and the spring is elastically fixed between a rear end of the cap and a spring stopper fixed to a rear end of the refill;

a front hole and a rear slit are continuously provided, in the shaft tube, behind the spring stopper, an insertion hole is projected downward in the knock part, and a button to be inserted into the insertion hole includes an upper body part, a middle body part and a lower body part, the upper body part having a diameter adapted to pass upward through the front hole, the rear slit and the insertion hole, the middle body part having a diameter adapted to pass upward through the front hole and the insertion hole and not passing upward through the rear slit, the lower body part having a diameter adapted to pass upward through the insertion hole and not passing upward through either the front hole or the rear slit, the lower body part is supported from a lower side and adapted to be powered upward by a vertical spring, and a lower end of the vertical spring is supported on one of:

a lower inner wall of the knock part and a lower inner wall of the shaft tube in a state of passing through a lower hole of the knock part;

wherein in a writing state, the middle body part projects upward to contact a rear end of the front hole, and the lower body part projects upward from the insertion hole to contact a front end of an inner wall of the insertion hole;

wherein in a not-writing state, the upper body part projects upward to contact a rear end of the rear slit, and the front end of the inner wall of the insertion hole contacts with the lower body part; and wherein the length of the knock part in a forward and reverse direction is set so that a rear end of the knock part projects backward more than the rear end of the shaft tube.

2. The slim type ballpoint pen according to claim 1 wherein the insertion hole is projected so as to reach a lower inner wall of the knock part.

3. The slim type ballpoint pen according to claim 1 wherein a touch plate having a diameter larger than that of the upper body part and touchable with a finger is provided at a top part of the button.

4. The slim type ballpoint pen according to claim 1 wherein a spring winding body part having a diameter smaller than that of the lower body part is projected downward on a lower end of the lower body part, the vertical spring is wound around the spring winding body part, and an upper end of the spring powers a lower end surface of the lower body part upward.

5. The slim type ballpoint pen according to claim 1 wherein a spring insertion hollow part is provided through a part of the lower body part, and an upper end of the vertical spring powers an upper end surface of the hollow part upward.

6. A slim type ballpoint pen comprising:

a shaft tube having a cap secured to a forward end thereof, a refill having a pipe storing ink therein and a pen tip housed in the tube for movement in forward and reverse directions, an arrangement for moving the pen tip in the forward and reverse directions, the arrangement including a knock part and a backward elastic force of a spring, respectively, the pipe storing ink along a longitudinal direction of the shaft tube and the knock part being movable in the forward and reverse directions and being fitted at a rear end of the shaft tube, and the spring is elastically fixed between a rear end of the cap and a spring stopper fixed to a rear end of the refill;

a front hole and a rear slit are continuously provided, in the shaft tube, behind the spring stopper, an insertion hole is projected downward in the knock part, a fitting-in hole is provided in the knock part, a columnar part molded integrally with a lower part of a projection movable in a state of passing upward through the front slit is fitted into the fitting-in hole in front of the insertion hole, the projection is fixed to the fitting-in hole by one of press-bonding and adhering the columnar part to an inner wall of the fitting-in hole with an adhesive agent, a button to be inserted into the insertion hole includes an upper body part, a middle body part and a lower body part, the upper body part having a diameter adapted to pass upward through the front hole, the rear slit and the insertion hole, the middle body part having a diameter adapted to pass upward through the front hole and the insertion hole and not passing through the rear slit, the lower body part having a diameter adapted to pass upward through the insertion hole and not passing upward through either the front hole or the rear slit, the lower body part is supported from a lower side and adapted to be powered upward by a vertical spring, and a lower end of the vertical spring is supported on one of:

a lower inner wall of the knock part and a lower inner wall of the shaft tube in a state of passing through a lower hole of the knock part;

wherein in a writing state, the middle body part projects upward to contact a rear end of the front hole, and the lower body part projects upward from the insertion hole to contact a front end of an inner wall of the insertion hole;

wherein in a not-writing state, the upper body part projects upward to contact a rear end of the rear slit, and the front end of the inner wall of the insertion hole contacts with the lower body part; and wherein the length of the knock part in a forward and reverse direction is set so that a rear end of the knock part does not project backward more than the rear end of the shaft tube.

7. The slim type ballpoint pen according to claim 6 wherein the insertion hole is projected so as to reach a lower inner wall of the knock part.

8. The slim type ballpoint pen according to claim 6 wherein a touch plate having a diameter larger than that of the upper body part and touchable with a finger is provided at a top part of the button.

9. The slim type ballpoint pen according to claim 6 wherein a spring winding body part having a diameter smaller than that of the lower body part is projected downward on a lower end of the lower body part, the vertical spring is wound around the spring winding body part, and an upper end of the spring powers a lower end surface of the lower body part upward.

10. The slim type ballpoint pen according to claim 6 wherein a spring insertion hollow part is provided through a part of the lower body part, and an upper end of the vertical spring powers an upper end surface of the hollow part upward.

* * * * *